US006109003A

United States Patent [19]

Benz

[11] Patent Number: 6,109,003

[45] Date of Patent: Aug. 29, 2000

[54] METHOD FOR BUNDLING SIDE-FOLD BAGS

[75] Inventor: Gottlieb Benz, Flums, Switzerland

[73] Assignee: Hinterkopf GmbH, Eislingen, Germany

[21] Appl. No.: 09/105,562

[22] Filed: Jun. 26, 1998

[30] Foreign Application Priority Data

| | | | |
|---|---|---|---|
| Apr. 4, 2000 | [CH] | Switzerland | 2346/97 |
| Apr. 18, 2000 | [CH] | Switzerland | 1551/97 |

[51] Int. Cl.[7] ..... B65B 11/00

[52] U.S. Cl. ..... 53/397; 53/204; 493/384

[58] Field of Search ..... 53/397, 204, 581, 53/409; 493/227, 394, 349, 351, 384, 393

[56] References Cited

U.S. PATENT DOCUMENTS

| | | | |
|---|---|---|---|
| 1,019,186 | 3/1912 | Roberts | 493/384 |
| 1,513,898 | 11/1924 | Fleckser | 493/384 |
| 3,100,569 | 8/1963 | White . | |
| 4,665,679 | 5/1987 | Watanabe . | |
| 5,795,434 | 8/1998 | Ishikawa | 53/204 |

FOREIGN PATENT DOCUMENTS

| | | |
|---|---|---|
| 843548 | 10/1976 | Belgium . |
| 0 384 281 | 8/1990 | European Pat. Off. . |
| 694 692 | 8/1940 | Germany . |
| 23 59 324 | 6/1975 | Germany . |

*Primary Examiner*—John Sipos
*Assistant Examiner*—Steven Jensen
*Attorney, Agent, or Firm*—Pauley Petersen Kinne & Fejer

[57] ABSTRACT

A method and apparatus for the fixed combination of side-fold bags to form stacks. The side-fold bags to be combined, arriving from a machine which produces side-fold bags, are previously separated into stacks of a controlled quantity. During combining, each stack is oriented in relation to a perforating station, pressed together and punched with at least two through-holes. Each stack is interlockingly bundled by at least one intermediate fixation element, which is force-lockingly closed to form a loop, for the purpose of being further used in an automatic goods packing machine, where each stack is fixedly held in a packaging station by a fixing element in the shape of a hoop, which penetrates through the holes, wherein the intermediate fixation element is removed.

6 Claims, 3 Drawing Sheets

METHOD FOR BUNDLING SIDE-FOLD BAGS

BACKGROUND OF THE INVENTION

1. Field of the Invention

This invention relates to a method and an apparatus for a fixed combination of side-fold bags to form stacks, wherein the side-fold bags to be combined, which are coming from a machine which produces side-fold bags, have previously been separated into stacks of controllable quantity, and wherein during combining each stack is oriented in relation to a perforating station and is pressed together.

2. Description of Prior Art

In order to be able to automatically package goods, for example bread, it is necessary that the packaging is accurately oriented and is easy to handle. The automatic packaging of goods in paper or plastic bags in particular makes high demands. Generally, bags which have a side fold are used for this purpose, having one side at the open end of the bag which is not folded and forms a protruding tongue. Such bags are called side-fold bags. To allow automatic packaging, several side-fold bags are combined to form a stack by guiding a metal hoop through two holes punched into protruding tongues lying on top of each other. During packaging, a stack of side-fold bags is held in the packaging device in such a way that the side-fold bags lie flat on a packaging table with their sides having tongues down, and the open ends of the metal hoop project downward. The topmost side-fold bag is opened by blowing in air and the goods are inserted. Thereafter the side-fold bag with the goods is pulled away from the metal hoop in the longitudinal direction and the holes are ripped open in the process. Now the bag next below is inflated and goods packed in it.

The metal hoop assures that the respectively topmost bag can be inflated, while the lower, punched lateral surface is kept on the packaging table. The hoop additionally maintains the bags in a fixed position and allows the tearing off of the uppermost bag in a well-defined direction.

The stacks have the metal hoops during their manufacture and packing. To this end bags produced by the machine producing side-fold bags are counted in a counting device, counted stacks are pressed together, the protruding tongues are provided with two punched holes and a metal hoop is manually guided through the holes. For fixing the stack in place, a rubber band is manually wound around the open ends of the metal hoop. Thereafter the bundled stacks are packed and delivered to the packager.

The packaging method using metal hoops has proven itself but is disadvantageous because the metal hoops are awkward and therefore make the packing of the stacks more difficult. The fact that some steps must be manually performed further increases the packing costs. In addition, the metal hoop increases the total weight, which in turn increases transportation costs. It is furthermore necessary that the metal hoops be returned from the packager to the bag manufacturer to be reused.

SUMMARY OF THE INVENTION

It is one object of this invention to provide a method for fixing stacks of such side-fold bags in place which corrects the above mentioned disadvantages.

It is a further object of this invention to produce a device for bundling side-fold bags wherein the method of this invention is employed.

In accordance with the method of this invention, the side-fold bags coming from the production machine and made available in stacks in controllable quantities have an intermediate fixation which, in the form of a loop, interlockingly bundles the stack. The intermediate fixation preferably comprises two tapes which are guided through the through-holes of the stack and whose sections which come to rest on top of each other are connected with each other, so that each tape forms a closed loop. Thus the sections are preferably welded together. By means of the tapes the bags are fixed to form a bundle without being able to displace each other.

Now the bundling and packing of the side-fold bags can be performed completely automatically. In addition, the bundles are easier to pack because they can be welded in foils, for example.

So that the bundles can be used for automatic packaging of goods, the known metal hoops are pushed through the holes in the bundle by the goods packager and the tapes are preferably cut. Therefore the automatic packaging method for goods remains unchanged.

An exemplary embodiment of the device in accordance with this invention is represented in the attached drawings, by means of which the method in accordance with this invention will be described.

DESCRIPTION OF PREFERRED EMBODIMENTS

Figure 1A:
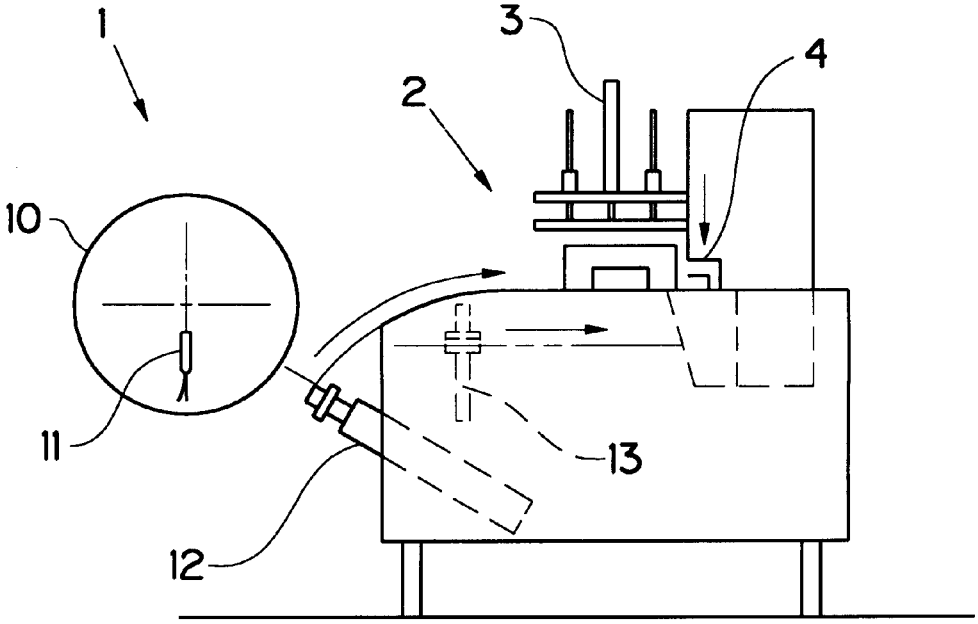
FIG. 1*a* is a schematic side view of a device in accordance with the invention.
Figure 1B:
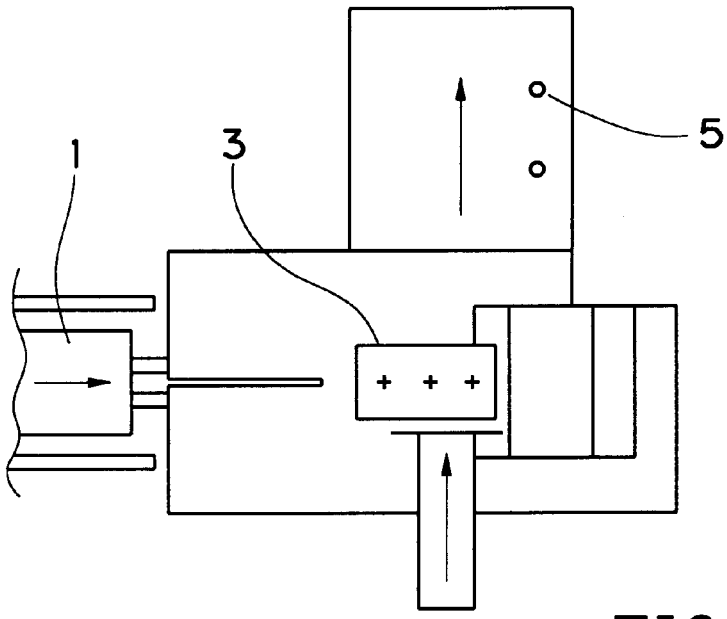
FIG. 1*b* is a schematic top view of the invention shown in FIG. 1*a;*

A device in accordance with this invention for side-fold bags, also called a bag bundling machine, is schematically represented in FIGS. 1*a* and 1*b*. Side-fold bags 6', shown in FIG. 3*a*, coming from a bag-producing machine are conveyed through a reception station 1 to the bag bundling machine. The reception station 1 is known from the prior art and in general comprises a conveyor drum 10 with a counting unit 11 for counting the bags 6', a pivot station 12 for taking the bags 6' off the conveyor drum 10 and for transferring the bags 6' in stacks to an input station 13, where the formed stack 6 is turned into the desired position and is handed over transversely to its longitudinal direction, defined by the opening in the bags 6', to the bag bundling machine, or more specifically to a conveyor unit 2. The counted and stacked side-fold bags 6' are aligned in the conveyor unit 2 and are transferred to a pressing station 3, where the bags 6' are pressed together and are conveyed on by the conveyor unit 2 to a perforating station 4. From there, the stacked bags 6' come to a tape station 5, where the individual stacks 6 are fixed in place as bundles.

Figure 2A:
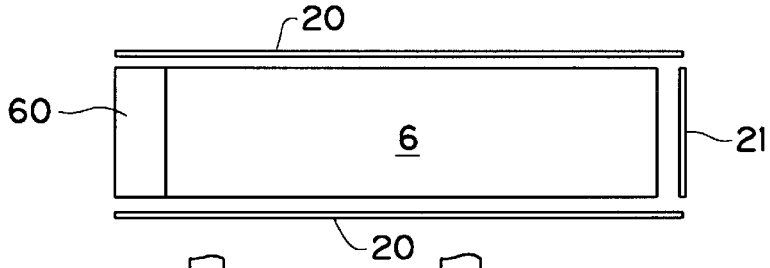
FIGS. 2*a* to 2*h* each show a schematic top view of individual method steps in the perforation and tape station.

The individual method steps for bundling the stacked side-fold bags 6' are represent ed in FIGS. 2*a* to 2*h*, starting from the conveyor unit 2 up to the tape station 5. A stack 6, which rests on a conveying element of the conveyor unit 2, is shown in FIG. 2*a*. On its side which is not folded, each side-fold bag 6' has a protruding tongue 60. This side i s downward oriented.

Figure 2B:
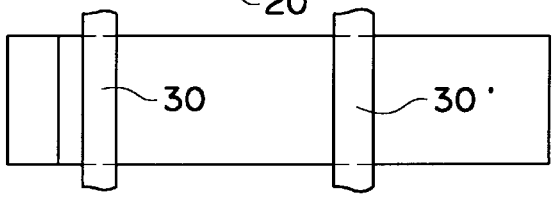

The stack 6 is aligned in the conveyor unit 2 by means of lateral and rear bag guide elements 20, 21 and is conveyed in the longitudinal direction to the pressing station 3. In a next step, the stack 6 is pressed together in the pressing station 3 by means of first bag pressing elements 30, 30', for example by two clamping bars which are height-adjustable and arranged at a distance from each other, wherein preferably the lateral and rear bag guide elements 20, 21 continue to adjust the stack 6 during the pressing process. This is shown in FIG. 2*b*.

Figure 2C:
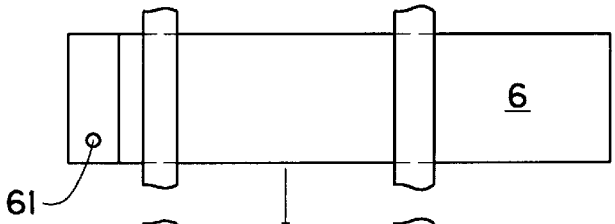
Figure 2D:
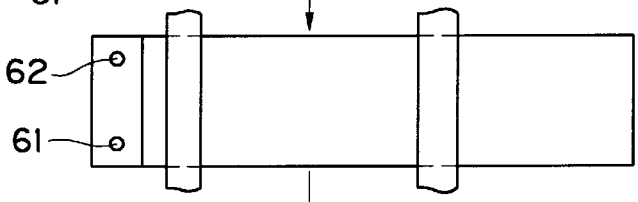

Subsequently the stack 6, pressed together by the first bag pressing elements 30, 30', is moved transversely to its longitudinal direction to the perforating station 4, where a continuous hole 61 is punched through the protruding tongues of the bags 6' by means of a known punch element, as represented in FIG. 2*c*. The production of the hole does not necessarily have to be done by punching, other ways, for example drilling, are also possible. Subsequently the stack 6 is conveyed by a defined distance transversely to its longitudinal direction by the conveyor unit 2, so that a second hole 62 is punched through the protruding tongues 60 at a distance which corresponds to the width of a metal hoop employed in the automatic packaging of goods, as shown in FIG. 2*d*. It is also possible to produce both holes 61, 62 simultaneously. However, the embodiment described here has the advantage that it is possible to operate at a lesser punching pressure.

Figure 2E:
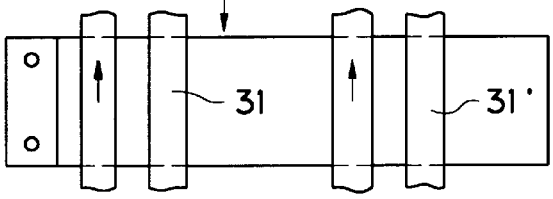

Now, as shown in FIG. 2*e*, the transfer of the pressed stack 6 from the first bag pressing elements 30, 30' to second bag pressing elements 31, 31' takes place. This transfer is not necessary, the stack 6 can also be conveyed on by means of the first bag pressing elements 30, 30'. However, this transfer increases the frequency with which the individual stacks 6 can be inserted into the bag bundling machine. These second bag pressing elements 31, 31' are preferably embodied the same way as the first ones, for example they again are two spaced-apart clamping bars but are arranged offset with respect to the first ones.

Figure 2F:
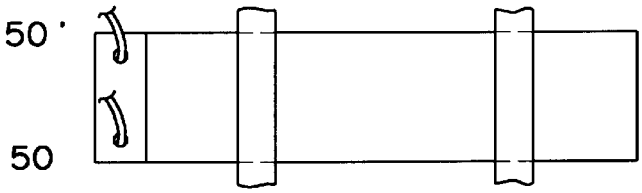
Figure 2G:
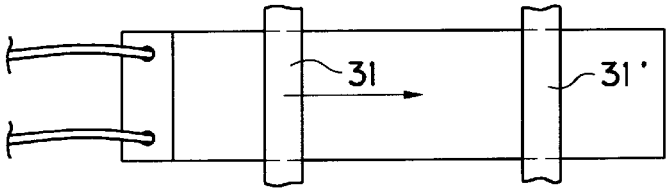
Figure 2H:
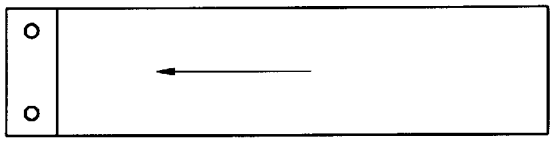

The next step is shown in FIG. 2*f*. In the pressed state, the stack 6 is again moved transversely with respect to its longitudinal direction to the tape station 5, wherein respective tapes 50, 50' from respective rolls of tape, not shown, are introduced into the two spaced-apart holes 61, 62. Thereafter, as shown in FIG. 2*g*, the stack 6 is moved together, or by means of the second bag pressing elements 31, 31' in the longitudinal direction, therefore transversely in relation to its conveying direction up to now, toward the rear, for example away from the tape station 5. In this position the tapes 50, 50' are separately welded into loops and cut off the tape roll. Finally, as shown in FIG. 2*h*, the second bag pressing elements 31, 31' are moved back to the transfer station and the bundled stack 6 is conducted to a further packing station, not shown. In FIG. 2*h*, tapes 50, 50' have been removed from stack 6 and a fixing element penetrates through holes 61, 62 to fixedly hold the stack.

The method steps by which the stack 6 is tied together by tapes 50, 50' are shown from a different perspective in FIGS. 3*a* to 3*f*. The side-fold bags 6' are represented at a distance from each other for greater clarity, although they are pressed on each other during these method steps.

Figure 3A:
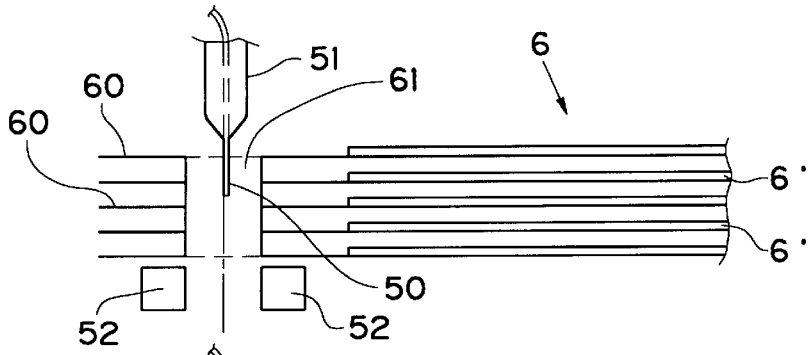
FIGS. 3*a* to 3*f* each show a schematic side view of the individual method steps in the perforation and tape station.
Figure 3B:
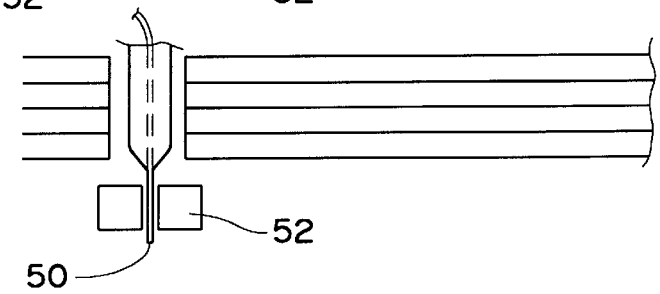
Figure 3C:
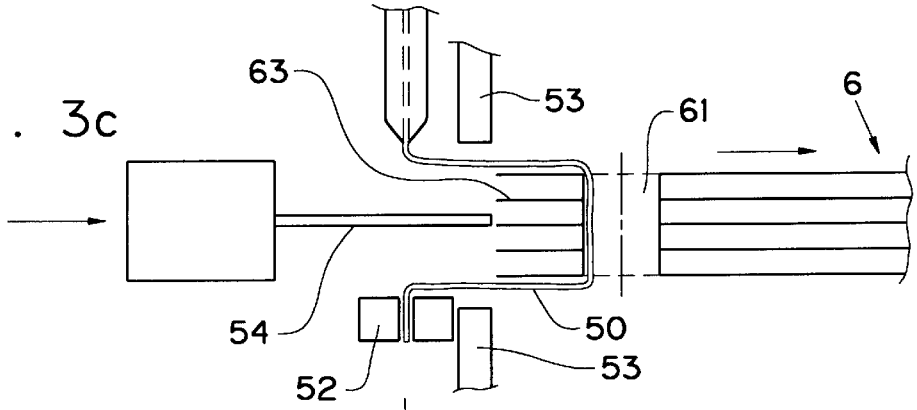
Figure 3D:
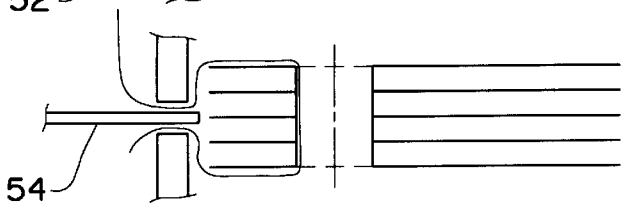
Figure 3E:
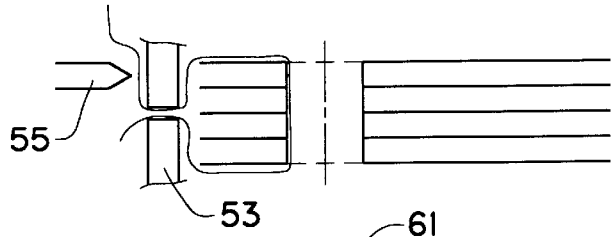

The method step shown in FIG. 3*a* corresponds to the situation represented in FIG. 2*f*, but only the first hole 61 and the first tape 50 are visible. However, the second hole 62 preferably has a second tape 50' at the same time. The tape 50 is introduced into the hole 61 of the stack 6 by means of a tape guide element 51, which can be displaced in height. Suitable as a tape guide element 51 is, for example, a stiff sleeve, through which the tape 50 can be displaceably moved, and which tapers toward the end facing the stack, wherein a short end of the tape 50 protrudes from the sleeve. The tape guide element 51 is introduced into the hole 61 until the protruding end of the tape 50 projects on the underside of the stack 6 into a tape fixing element 52, which for example is formed by two clamping jaws arranged under the stack 6. The clamping jaws are moved toward each other and fix the tape 50 in its position, as shown in FIG. 3*b*. Thereafter, as shown in FIG. 3*c*, the tape guide element 51 is moved upward and the stack 6 in the pressed state is moved toward the rear, as already shown in FIG. 2*g*, away from the tape station. Because of this the tape 50 is unwound from a tape roll, not shown, until sufficiently long sections of the tape 50 protrude on both sides of the hole 61 past the front edge 63 of the stack 6. A welding tongue 54 is moved closely in front of the front edge 63 of the stack 6. Other welding tongues, not shown, are provided for the further tapes. Subsequently, as shown in FIG. 3*d*, tape pressing elements 53, for example again oppositely located clampingjaws, are moved together on both sides of the stack 6 from above and below, and the tape sections protruding past the front edge 63 are brought to the heated welding tongue 54. The welding tongue 54 is retracted after a predefined length of time and the heated tape sections are pressed on each other by means of the tape pressing elements 53. In FIG. 3*e* the tape section connected with the tape roll is cut off by means of a separating element 55, for example a cutter, wherein the separation occurs at a place shortly back of the welded connection and sufficiently far removed from the lower end of the tape guide element 51, so that the end of the tape 50 required for the next bundling again protrudes from the tape guide element 51.

Figure 3F:
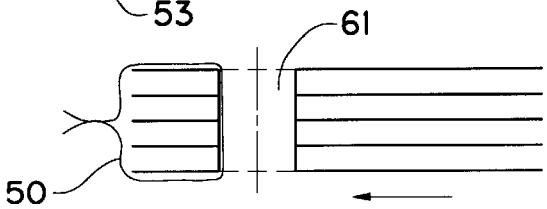

The stack 6, now bundled by means of an intermediate fixation, is again pushed forward in accordance with FIG. 3*f* and from there the bundled stack 6 is conveyed to a packing station, not shown, where the several bundles are packed together in boxes or foil.

The method in accordance with this invention leads to the desired end in this general form. However, tests have shown that it is advantageous to make the holes non-circular, but in such a way that a predefined breaking point is formed on the bag, so that, when the bags 6' are inserted into a goods packaging machine, every bag is torn out of its fastening exactly in the longitudinal direction. It is thus advantageous to provide the holes with a notch oriented toward the front edge, for example, or to make the holes cornered, wherein one corner is oriented toward the front edge. It has also been found to be advantageous to use as tape those tapes used for baling, since they can be welded in a simple manner without shrinking. They furthermore are sufficiently stiff to prevent the displacement of the individual bags in relation to each other. Welding by means of the welding tongue can be performed very closely in front of the front edge of the stack 6 without the individual bags being affected by the heat or perhaps even welded together. The weld bead can be kept comparatively short, so that the tape welded into a loop projects only a little in front of the stack 6 and therefore does not interfere with packing. Furthermore, shorter lengths are sufficient for tying the bags together.

In another preferred embodiment of the method, the side-fold bags already have holes, so that this method step is omitted from the device in accordance with this invention. This is advantageous, for example, when the bundles are too thick to be easily punched. In this case an alignment station is advantageously provided in place of the punching station, which has pins that are conducted through the holes of the side-fold bags and thereby align the bags.

What is claimed is:

1. In a method for fixedly combining a plurality of side-fold bags (6') to form a plurality of stacks (6), including separating the side-fold bags (6') into the stacks (6) in a controlled quantity, orienting each stack (6) of the stacks (6) transversely to a longitudinal direction of the stacks (6) in relation to a perforating station (4), and pressing together the side-fold bags (6') of each stack (6) of the stacks (6), the improvement comprising:

punching a first hole (61) through the side-fold bags (6') of each stack (6) of the stacks (6);

conveying each stack (6) of the stacks (6) by a defined distance transversely to the longitudinal direction;

punching a second hole (62) through the side-fold bags (6') of each stack (6) of the stacks (6);

transferring each stack (6) of the stacks (6) from a plurality of first bag pressing elements (30, 30') to a plurality of second bag pressing elements (31, 31');

interlockingly bundling each stack (6) of the stacks (6) with at least one intermediate fixation element which is force-lockingly closed to form a loop for using the bundled stacks (6) in an automatic goods packaging machine; and fixedly holding each stack (6) of the stacks (6) in a packaging station with a fixing element having a shape of a hoop, the fixing element penetrating through the first hole (61) and the second hole (62), wherein the at least one intermediate fixation element is removed.

2. In the method in accordance with claim 1, wherein the at least one intermediate fixation element comprises a tape (50, 50'), which is introduced into one of the first hole (61) and the second hole (62) of the stack (6), and a plurality of tape sections protruding past a front edge (63) of each stack (6) of the stacks (6) are pressed on each other, forming a loop to bundle each stack (6) of the stacks (6) in an interlocking manner.

3. In the method in accordance with claim 2, wherein the tape sections are welded together.

4. In the method in accordance with claim 3, wherein a heated welding tongue (54) is moved between the tape sections, the tape sections are pressed on the welding tongue (54), and after a first predefined length of time the welding tongue (54) is moved away from the tape sections and the tape sections are pressed against each other for a second predefined length of time.

5. In the method in accordance with claim 1, wherein at least one tape (50, 50') is delivered by a tape roll, an end of the at least one tape (50, 50') introduced into one of the first hole (61) and the second hole (62) is held in place on an underside of each stack (6) of the stacks (6), and after the at least one tape (50, 50') passes through each stack (6) of the stacks (6), each stack (6) of the stacks (6) is conveyed a defined distance in a direction away from a plurality of tape pressing elements (53), and a plurality of protruding sections of the at least one tape (50, 50') are pressed against each other.

6. In a method for fixedly combining a plurality of side-fold bags (6') to form a plurality of stacks (6), including separating the side-fold bags (6') into the stacks (6) in a controlled quantity, orienting each stack (6) of the stacks (6) transversely to a longitudinal direction of the stacks (6) in relation to a perforating station (4), and pressing together the side-fold bags (6') of each stack (6) of the stacks (6), the improvement comprising:

punching at least two holes (61, 62) in each stack (6) of the stacks (6), wherein the at least two holes (61, 62) are punched one after the other;

conveying each stack (6) of the stacks (6) by a defined distance transversely to the longitudinal direction;

transferring each stack (6) of the stacks (6) from a plurality of first bag pressing elements (30, 30') to a plurality of second bag pressing elements (31, 31');

interlockingly bundling each stack (6) of the stacks (6) with at least one intermediate fixation element which is force-lockingly closed to form a loop for using a bundled group of the stacks (6) in an automatic goods packaging machine;

wherein at least one tape (50, 50') is delivered by a tape roll, an end of the at least one tape (50, 50') is introduced into one of the first hole (61) and the second hole (62) and is held in place on an underside of each stack (6) of the stacks (6);

conveying each stack (6) of the stacks (6) after the at least one tape (50, 50') passes through each stack (6) of the stacks (6), a defined distance in a direction away from a plurality of tape pressing elements (53);

moving a heated welding tongue (54) between a plurality of protruding sections of the tape (50, 50'), pressing the protruding sections on the welding tongue (54) on both sides, and after a first predefined length of time moving the welding tongue (54) away from the protruding sections and pressing the protruding sections together for a second predefined length of time; and fixedly holding each stack (6) of the stacks (6) in a packaging station with a fixing element having a shape of a hoop, the fixing element penetrating through the first hole (61) and the second hole (62), wherein the at least one intermediate fixation element is removed.

* * * * *